United States Patent [19]

Miyanaga et al.

[11] 4,117,275

[45] Sep. 26, 1978

[54] NON-DIRECTIONAL ELECTRET MICROPHONE WITH AN AIR PASSAGE TO BALANCE PRESSURES ON OPPOSITE SIDES OF THE DIAPHRAGM

[75] Inventors: Kunio Miyanaga; Kosaku Kawada, both of Miyagi, Japan

[73] Assignee: Chemi-Con Onkyo Co., Ltd., Miyagi, Japan

[21] Appl. No.: 806,129

[22] Filed: Jun. 13, 1977

[30] Foreign Application Priority Data

Jun. 11, 1976 [JP] Japan ..... 51-075775[U]

[51] Int. Cl.[2] ..... H04R 19/04

[52] U.S. Cl. ..... 179/111 E

[58] Field of Search ..... 179/111 E, 111 R

[56] References Cited

U.S. PATENT DOCUMENTS

| | | | |
|---|---|---|---|
| 3,646,281 | 2/1972 | McGunigle | 179/111 R |
| 3,816,671 | 6/1974 | Fraim et al. | 179/111 E |

FOREIGN PATENT DOCUMENTS

| | | | |
|---|---|---|---|
| 2,149,192 | 4/1972 | Fed. Rep. of Germany | 179/111 R |
| 46-35,035 | 10/1971 | Japan | 179/111 R |

*Primary Examiner*—George G. Stellar

*Attorney, Agent, or Firm*—Sughrue, Rothwell, Mion, Zinn and Macpeak

[57] ABSTRACT

A non-directional capacitive microphone assembly comprises an electrically conductive casing which is air-tight except at least one sound hole formed in front end of the casing and a capacitive diaphragm disposed behind the sound hole. The sound hole is communicated with a cavity formed behind the diaphragm through an air passage provided in the casing.

7 Claims, 6 Drawing Figures

NON-DIRECTIONAL ELECTRET MICROPHONE WITH AN AIR PASSAGE TO BALANCE PRESSURES ON OPPOSITE SIDES OF THE DIAPHRAGM

BACKGROUND OF THE INVENTION

A non-directional capacitive microphone has been employed for a microphone to be housed in a housing of such as cassette type magnetic tape recorder. In this case, it has been usual to encase the microphone in a box or casing of such as aluminum. In arranging the non-directional capacitive microphone encased by the aluminum box in the casing, it has been also usual to make the rear portion and the peripheral side portion of the casing air-tight to prevent the microphone from picking up noises such as mechanical sounds generated by motor and/or vibrations of mechanical components disposed behind the microphone.

However, when the casing of the microphone is air-tightly sealed, it becomes impossible to regulate air pressures in the both sides of a diaphragm in the casing, causing the frequency characteristics of the microphone to be degraded. In order to resolve this problem, it has been usual to provide at least one hole in the rear wall or the peripheral side wall of the microphone casing, leaving the noise pick-up problem as it is.

SUMMARY OF THE INVENTION

The present invention relates to an improvement on the non-directional capacitive microphone assembly for use in such as cassette type magnetic tape recorder and an object of the present invention is to resolve the noise pick-up problem of the non-directional capacitive microphone while the frequency characteristics thereof is maintained.

According to the present invention, the above object can be achieved by providing a novel casing structure for the non-directional capacitive microphone. The casing of the present invention is completely sealed air-tightly except a front wall thereof to prevent any mechanical noise generated behind the casing from entering into the casing and allow the both sides of the diaphragm in the casing to be communicated with each other so that the air pressure behind the diaphragm in the casing is responsible to the atmospheric pressure, to thereby maintain the frequency characteristics of the microphone without degradation.

BRIEF DESCRIPTION OF THE DRAWINGS

FIG. 3*b* is a plane view of a modification of the spacer in FIG. 3*a.

DETAILED DESCRIPTION OF THE EMBODIMENTS

Figure 1:
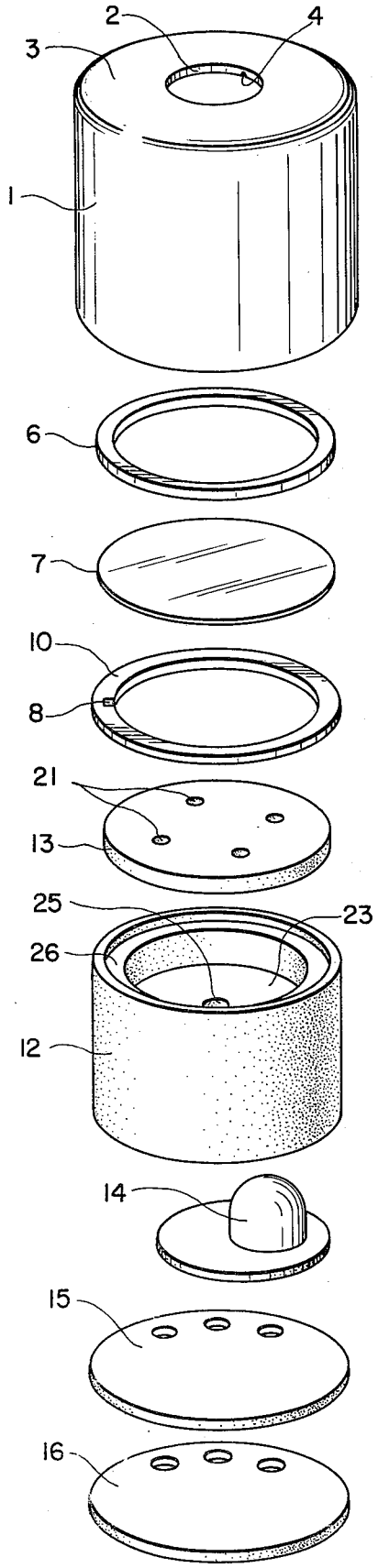
FIG. 1 is a perspective view of an embodiment of the present invention in a disassembled state.
Figure 2A:
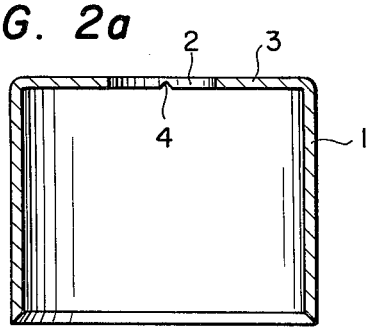
FIG. 2*a* is a cross section of a casing in FIG. 1.
Figure 2B:
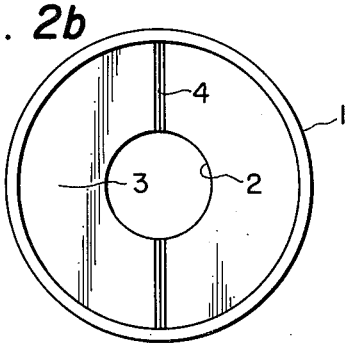
FIG. 2*b* is a bottom view of the casing in FIG. 2*a;*
Figure 3A:
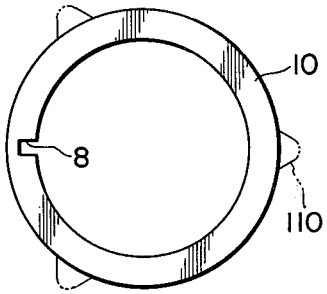
FIG. 3*a* is a plane view of a spacer in FIG. 1.

In FIG. 1 which shows an embodiment of the non-directional capacitive microphone assembly according to the present invention in a disassembled state, the non-directional capacitive microphone comprises a generally bell shaped casing 1 of metal material such as aluminum having a center sound hole 2 in a top wall 3 thereof. In an inner surface of the top wall 3, a groove 4 is formed, which extends throughout the inner diameter of the casing 1 as best shown in FIGS. 2*a* and 2*b*, a support ring 6 of metal having an outer diameter slightly smaller than the inner diameter of the casing 1 for adhesively support an electret film 7 spaced suitably apart from the inner surface of the top wall 3 of the casing 1, a thin annular spacer 10 of plastic material having a notch 8 in an inner periphery thereof as best shown in FIG. 3*a*, the outer diameter thereof being also smaller than the inner diameter of the casing 1, an electrode plate 13 formed with a plurality of holes 21 and a support member 12 of synthetic resin in the form of a cylinder having a partition wall 23 diving the interior of the cylinder into an upper chamber 22 and a lower chamber 24. The partition wall 23 is formed with a through-hole through which a lead wire can be passed. The support member 12 is further formed in an inner periphery of the upper end of the cylinder with an annular shoulder 26 which when assembled receives the electrode plate 13.

The microphone assembly further comprises an electronic circuit device such as amplifier 14, a plate 15 of elastic material such as rubber and a printed circuit board 16 which is also used to a closure of the open end of the casing 1. The outer diameter of the support member 12 is also made slightly smaller than the inner diameter of the casing and the diameter of the elastic plate 15 is made just equal to or slightly larger than the inner diameter of the casing 1. The diameter of the printed circuit board 16 is made equal to or slightly smaller than the inner diameter of the casing so that when assembled, it can close, together with the elastic plate 15, the open end of the casing air-tightly.

Figure 3B:
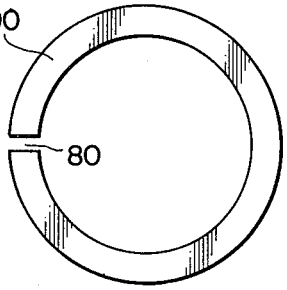

The annular spacer 10 in FIG. 3*a* may be substituted by a spacer 100 in FIG. 3*b* which has a cut-away portion 80 instead of the notch 8 of the spacer 10.

Figure 4:
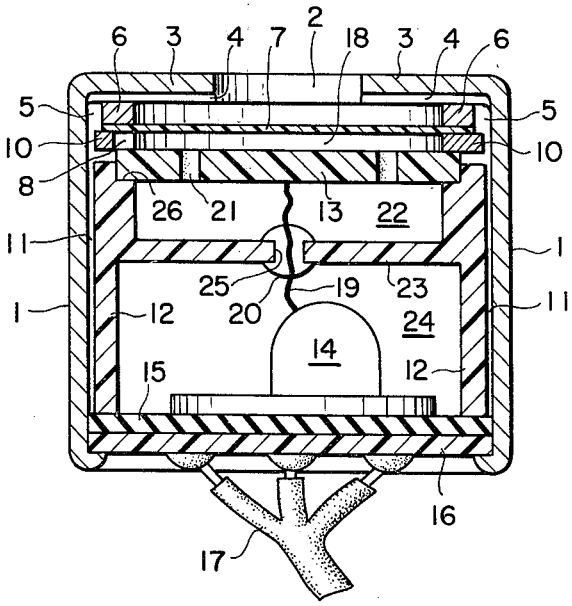
* and FIG. 4 is a cross sectional view of the embodiment in FIG. 1, in an assembled state.

FIG. 4 shows the non-directional capacitive microphone assembly in cross section.

The electret film 7 is suitably bonded to the lower surface of the spacer ring 6 to form a conversion unit and the amplifier device 14 is suitably attached on one surface of the elastic plate 15. The unit, the annular spacer 10, the electrode plate 13, the support member 12 are stacked coaxially in the order as shown in FIG. 4 and a lead wire 19 connected to the lower surface of the electrode plate 13 is guided through the upper chamber 22 of the support member 12 and the hole 25 of the partition wall 23 to the lower chamber 24 of the support member 12. Thereafter the hole 25 is sealed by a suitable resin 20 to pneumatically separate the upper chamber 22 from the lower chamber 34.

On the other hand, the amplifier device 14 is suitably electrically connected through the elastic plate 15 to the printed circuit board 16 and the lead wire 19 is also connected to the amplifier device 14. The assembly of the amplifier device 14, the elastic sealing plate 15 and the printed circuit board 16 is then inserted coaxially into the casing 1. Thereafter the lower peripheral edge of the casing 1 is deformed by caulking to seal the rear side of the casing 1. Leads 17 are connected suitably to the circuit board 16. The other from the electrode of the capacitor formed by the electret film 7 is connected through the ring 6 and the casing 1 to the printed circuit 16 suitably.

Since the non-directional capacitive microphone assembly thus constructed, the rear side and the peripheral side of the casing 1 are completely sealed, any mechanical noises possibly generated in the backside of the casing 1 cannot enter into the interior of the casing 1.

Further, due to the existence of the groove 4 in the inner surface of the top wall 3 of the casing 1, the atmospheric pressure can be transmitted through the sound hole 2, the groove 4 to an annular space 5 formed around the support ring 6 having the smaller diameter than the inner diameter of the casing 1. The atmospheric pressure is further transmitted through an annular space formed around the spacer 10 and the notch 8 thereof to a space 18 formed behind the electret film 7. Therefore, there is no pressure difference produced between the front side and the rear side of the electret film 7.

The space 18 is communicated through the holes 21 of the electrode plate 13 with the upper cavity 22 of the support member 12. The total volume of the space 18 and the cavity 22 is determined according to a desired frequency characteristics of the microphone as usual.

In order to maintain the coaxial arrangement of the components in the casing 1, suitable protrusions may be provided on the outer periphery of each of the support ring 6, the spacer 10 and the support member 12. For example, in FIG. *3a*, protrusions 110 shown by dotted lines may be provided equiangularly on the outer periphery of the spacer 10 so that the protrusions 110 contact with the inner side surface of the casing 1 to hold the spacer 10 coaxially with respect to the casing 1. The size and positions of the protrusions should be selected so as not to obstruct the fluid communication between the both sides of the electret film 7.

As described hereinbefore, according to the present invention, the non-directional capacitive microphone can maintain the frequency characteristics without the picking-up problem of mechanical noises generated behind the microphone.

What is claimed is:

1. A non-directional capacitive microphone assembly comprising:

(a) a generally cylindrical casing of electrically conductive material, said casing having an upper end closed except at least one sound hole, and a groove radially extending from said sound hole to the corner thereof in the inner surface of said closed upper end thereof;

(b) an electret diaphragm disposed in said casing in a facing relation to said sound hole to receive sound pressure through said sound hole, a front surface of said diaphragm being electrically connected to said casing;

(c) an electrode plate disposed in said casing and spaced apart from a rear surface of said diaphragm;

(d) a closure means for closing a lower end of said casing air-tightly;

(e) an electronic circuit means connected to said casing and said electrode plate;

(f) a ring-like spacer of electrically insulative material, said spacer being disposed between said diaphragm and said electrode plate to provide an air space therebetween, said spacer being formed at least in an inner portion thereof with a cut-away portion; and (g) an air passage for providing an air communication between a front side space and a rear side space of said diaphragm to balance air pressures therein, wherein said air passage is defined by said groove, the annular space defined by the inner surface of said casing and the peripheral surface of said diaphragm, the annular space defined by the inner surface of said casing and the surface of said spacer, and the annular space defined by the inner surface of said casing, the outer side surface of said electrode plate and said cut-away portion of said spacer.

2. A non-directional capacitive microphone assembly as claimed in claim 1, wherein said closure means includes an elastic plate and a printed circuit board.

3. A non-directional capacitive microphone assembly as claimed in claim 1, wherein said electret diaphragm is bonded to one surface of an electrically conductive ring, wherein the outer diameters of said conductive ring, and said spacer and said electrode plate are smaller than the inner diameter of said casing.

4. A non-directional capacitive microphone assembly as claimed in claim 3, further comprising means for holding said conductive ring, said spacer and said electrode plate coaxially with respect to said casing.

5. A non-directional capacitive microphone assembly as claimed in claim 1, further comprising a support member disposed in said casing for supporting said electrode plate.

6. A non-directional capacitive microphone assembly as claimed in claim 5, wherein said electrode plate has at least one through hole and wherein said support member defines a rear cavity for said diaphragm.

7. A non-directional capacitive microphone assembly as claimed in claim 6, wherein said support member has a horizontal partition wall to define said rear cavity above said partition wall and an air tight chamber for electronic circuit elements below said partition wall.

* * * * *